United States Patent [19]

Baptiste

[11] Patent Number: 4,821,341

[45] Date of Patent: Apr. 18, 1989

[54] SUN-VISOR AND HEADPIECE COMBINATION AND PACKAGE THEREFOR

[76] Inventor: Trevor I. Baptiste, 383 Grand Ave., Brooklyn, N.Y. 11238

[21] Appl. No.: 49,342

[22] Filed: May 13, 1987

[51] Int. Cl.[4] ..... A42B 1/06

[52] U.S. Cl. ..... 2/10; 2/199; 2/202; 2/197

[58] Field of Search ..... 2/10, 199, 202, 185 R, 2/12, 9, 8, 171, 197

[56] References Cited

U.S. PATENT DOCUMENTS

| | | | |
|---|---|---|---|
| 1,133,056 | 3/1915 | Pachner | 2/10 |
| 1,170,462 | 2/1916 | Schroeder | 2/10 |
| 1,216,635 | 2/1917 | Washington | 2/10 |
| 2,705,802 | 4/1955 | Tellier | 2/10 X |
| 2,870,451 | 1/1959 | Brodsky | 2/202 |
| 3,373,444 | 3/1968 | Militello | 2/10 |
| 3,614,216 | 10/1971 | Rosenthal | 351/44 |
| 3,787,895 | 1/1974 | Belvedere | 2/10 |
| 3,872,516 | 3/1975 | Bird et al. | 2/202 |
| 4,030,140 | 6/1977 | Burt | 2/10 X |
| 4,139,133 | 3/1980 | Laibach et al. | 2/10 |
| 4,630,317 | 12/1986 | Brown et al. | 2/199 X |

*Primary Examiner*—Peter Nerbun

[57] ABSTRACT

A size adjustable sun-visor and headpiece combination adapted to be worn on the head of a wearer, the headpiece having a front portion to run across the forehead of the wearer and a rear portion extending downwardly to cover the backneck of the wearer. An elongated headband having a frontal portion secured to the front portion of the headpiece, and rightside and leftside portions being secured respectively to opposite sides of the rear portion of the headpiece. Elastic back portions connect the rightside and leftside portions of the headband together, and include buckles to adjust the headpiece to the headsize of the wearer. A button is provided on each of the rightside and leftside portions of the headband to secure the sun-visor to the headband, the sun-visor including two elastic straps secured to opposite sides thereof to form end loops to accommodate associated ones of the buttons to attach the sun-visor to the headband while permitting the end loops to be detached from their respective buttons for removal of the sun-visor from said headband.

15 Claims, 9 Drawing Sheets

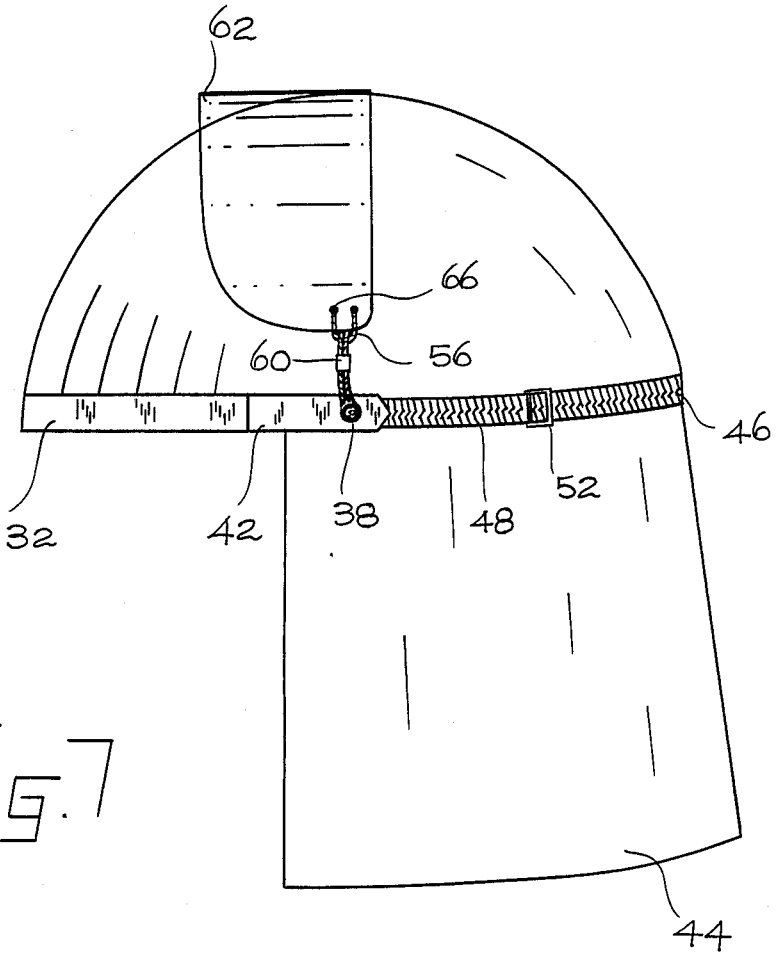
FIG. 7
FIG. 10
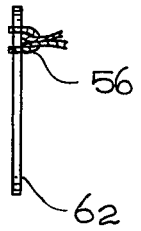

SUN-VISOR AND HEADPIECE COMBINATION AND PACKAGE THEREFOR

BACKGROUND OF THE INVENTION

The invention relates to a Sun-visor and Headpiece combination which shields the face and eyes in addition to protecting the hair of the user from the sun, dust, sand and the like.

In recent years the effect of the environment on human health, in particular the effect of the sun in skin care, has received great attention from the medical profession and general public. The American Cancer Society, in its 1980 facts and figures report, stated" . . . The vast majority of skin cancers can be prevented by avoiding over exposure to the sun . . . . "

Apart from skin cancer, aging of the face is and always has been a major preoccupation of women and men around the world. Today a wealth of information is available which supports the connection between aging of the skin and sunlight.

For the many millions of people who spend considerable amounts of time in the sun; on beaches, resorts, playgrounds and the like, a number of cosmetic-type products are available as sunscreens. However, without proper care, use of those products leads to further skin problems such as clogged pores. Also, in addition to the additional cost of reorders, such products do not offer the eyes and hair of user any protection from the sun.

Typical prior art consists of face shield and helmet combinations designed for use by motorcycle riders, or anti-radiation shields with head gear as used in the nuclear industry, or similar shields with or without head cover, used to protect workers from other hazards in the workplace. Such inventions however, were designed for specific use not related to exposure to the sun for extended periods of time, as in times of leisure; or to the protection of the face, eyes and hair of the user thereto stated. Where prior art suggest a face mask headpiece combination not related to the workplace, the headpiece, thereof, generally of baseball cap type configuration, *distinctly* prohibits upward and downward movement of the facemask and moreso shows no intent of a face mask which can be lifted or lifted and held in different positions above the face and head of user. Additionally, foregoing configurations are not adjustable as a whole, so as to constitute a size adjustable invention, or adapted to protect completely, the hair and neck of the user. Consequently, the advantages hereto mentioned, in summary, represents the state of prior art.

A primary objective of the invention is the combination of an adjustable headpiece, provided with an adjustable sun-visor, so as to constitute a size adjustable invention, said sun-visor having the ability to be lifted and held in different positions above the face and head of wearer, thus an invention liberated from the above-stated prior art oversight and deficiency. The benefit of a movable sun-visor in the instant invention, would be obvious to the wearer when going from a sunny to a shaded area. The wearer can shift the sun-visor above the head without removing it from the headpiece or without it falling off.

SUMMARY OF THE INVENTION

An adjustable sun-visor and adjustable headpiece combination is provided, said adjustable headpiece having a headcover made of fabric, which conforms to the general hairline contour of the head of humans, running across the forehead and falling at an angle of approximately 90°, in the vicinity of the ear to the shoulder and covering the backneck, said headcover attached to the headband that extends across the forehead and secured behind the head of wearer by two elastic bands integrated to said headband so as to provide adjustability to said headband and the headpiece as a whole. The frontal portion of said headband enclosing a highly absorbent sweat band. The right side and left side portions of said headband, fitted with two shank type buttons, each button positioned in the vicinity of the ear so as to hold the end loops of two dual loops elastic straps. Said dual loops elastic straps integrated to the top left and top right corners of the sun-visor. The elasticity of the straps allows for the sun-visor to be easily moved up and down the face of the wearer. Said buttons and end loops provision allow for the sun-visor to be removed from the headpiece if the wearer so desires. The sun-visor, cut from a flat sheet of clear or tinted yielding polymer material, with properties of reflecting or absorbing ultra-violet rays of the sun, is adapted with two dual loop straps to the headpiece as stated above.

BRIEF DESCRIPTION OF THE DRAWING

FIGS. 7 and 8 are side elevational views of present invention with sun-visor in two different positions;

FIG. 10 is a side elevational view of sun-visor in a neutral state with straps broken away for ease of illustration;

DESCRIPTION OF THE PREFERRED EMBODIMENT

Figure 1:
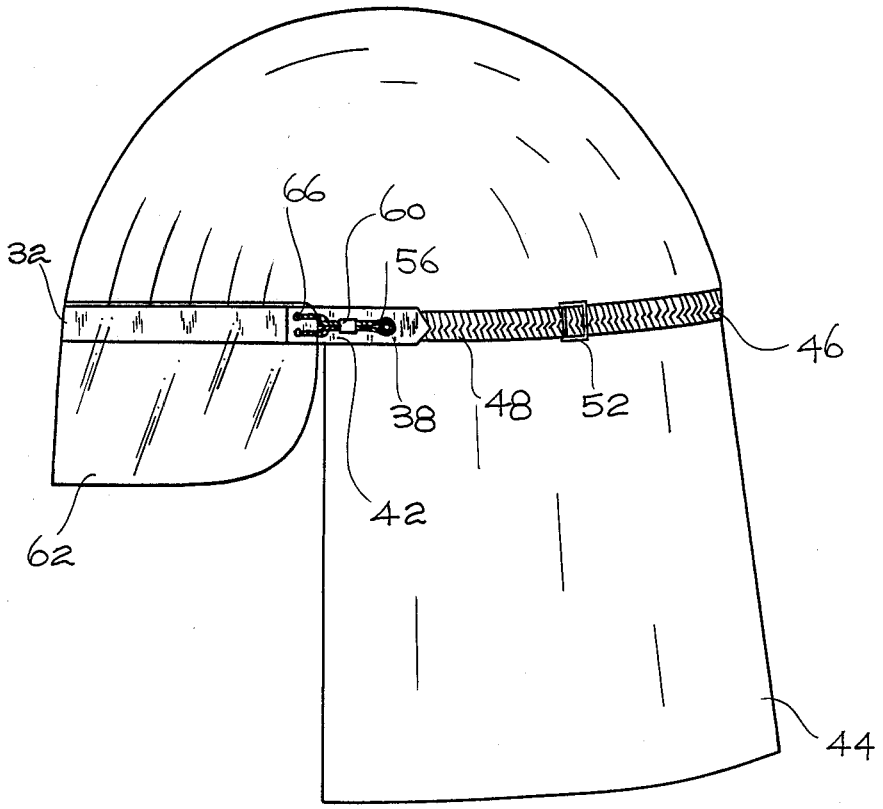
FIG. 1 is a side elevational view of the present invention.
Figure 2:
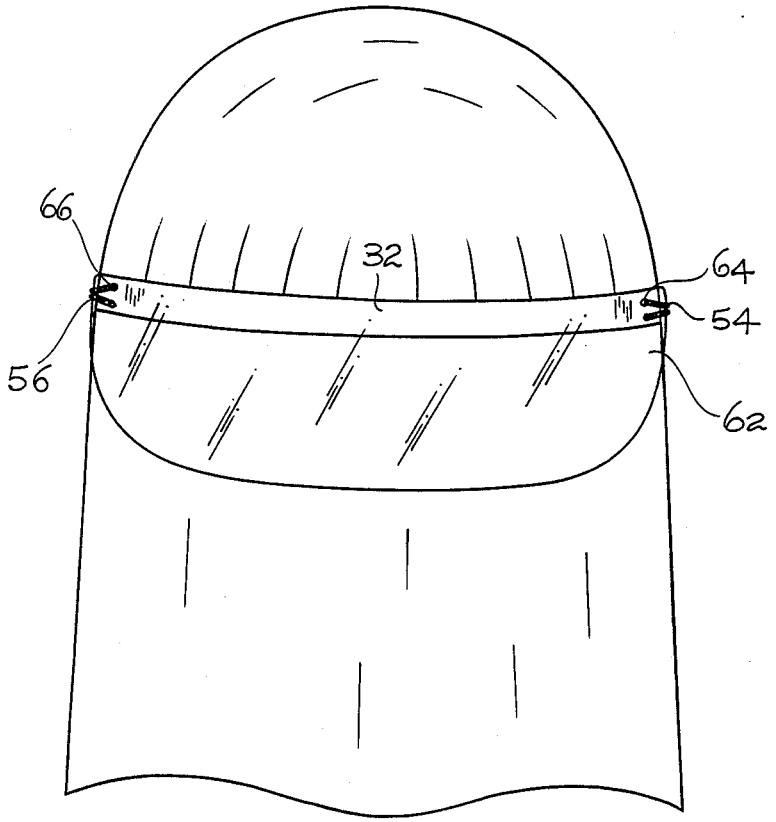
FIG. 2 is a front elevational thereof.
Figure 3:
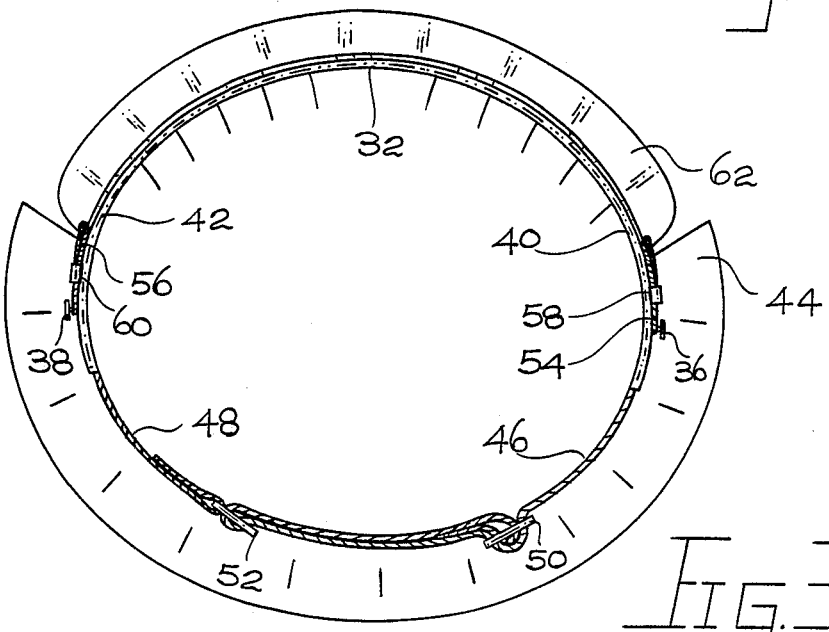
FIG. 3 is a top plan view thereof.
Figure 4:
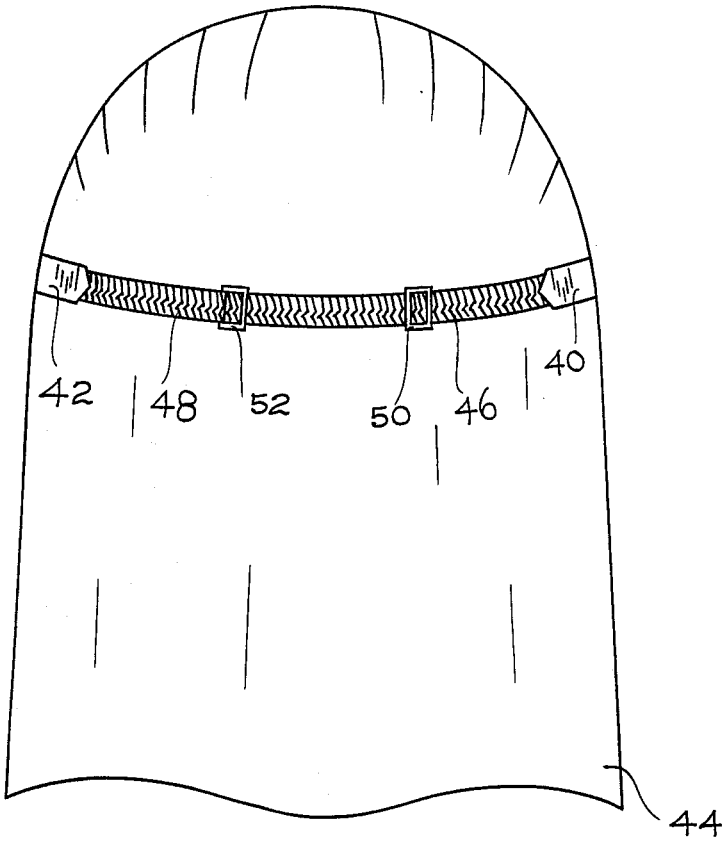
FIG. 4 is a back elevational view thereof.
Figure 5:
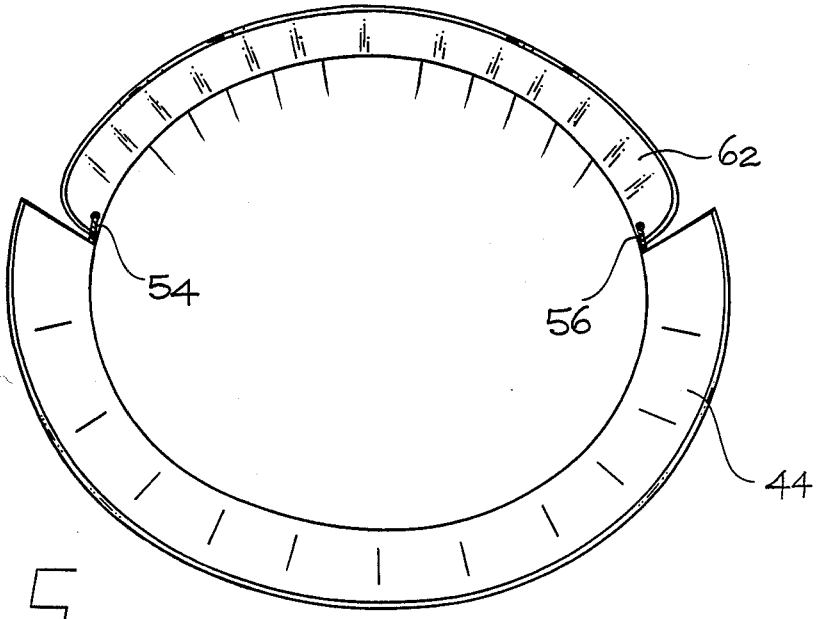
FIG. 5 is a bottom plan view thereof.
Figure 6:
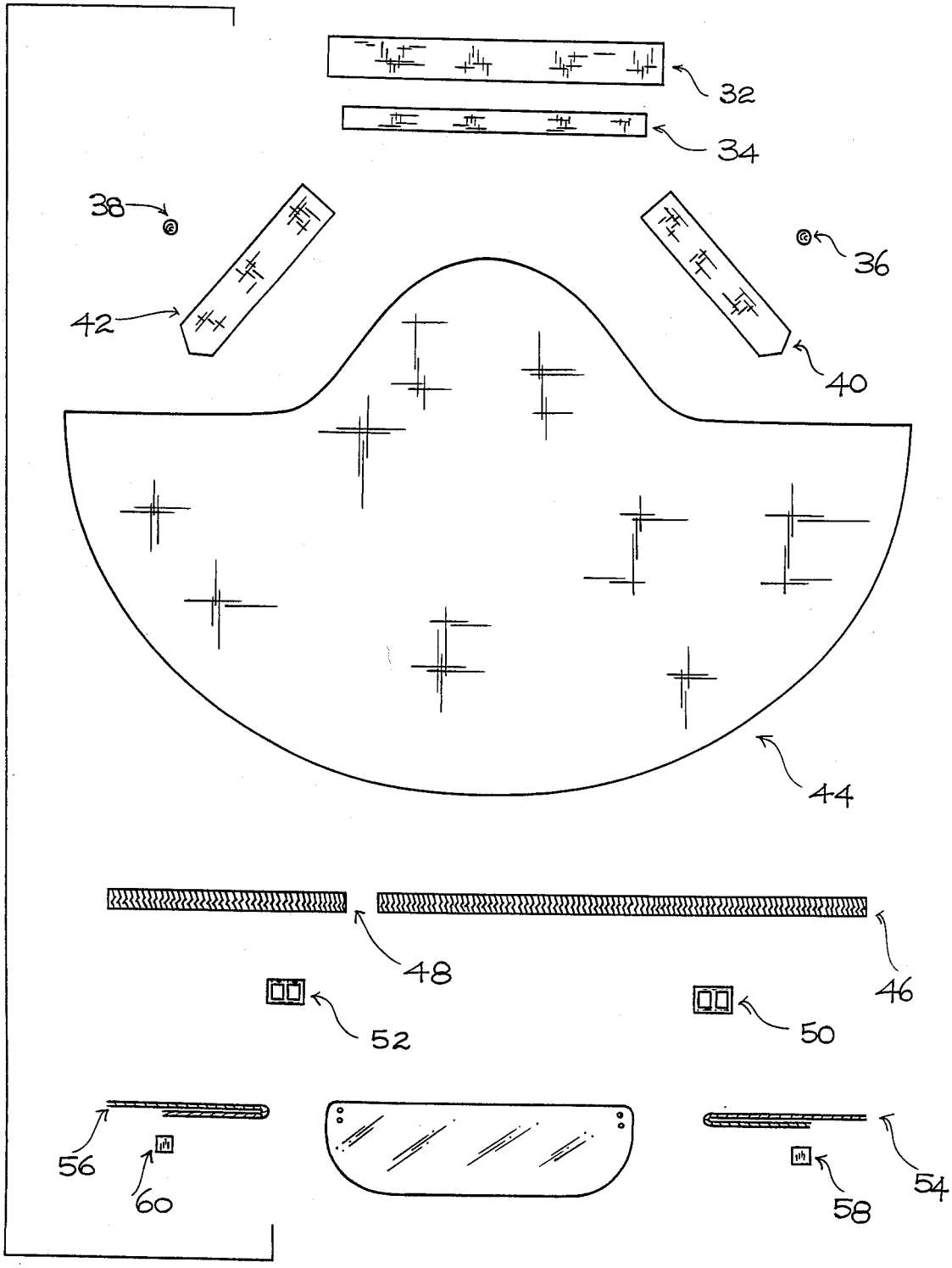
FIG. 6 is a reduced exploded top plan view thereof.
Figure 8:
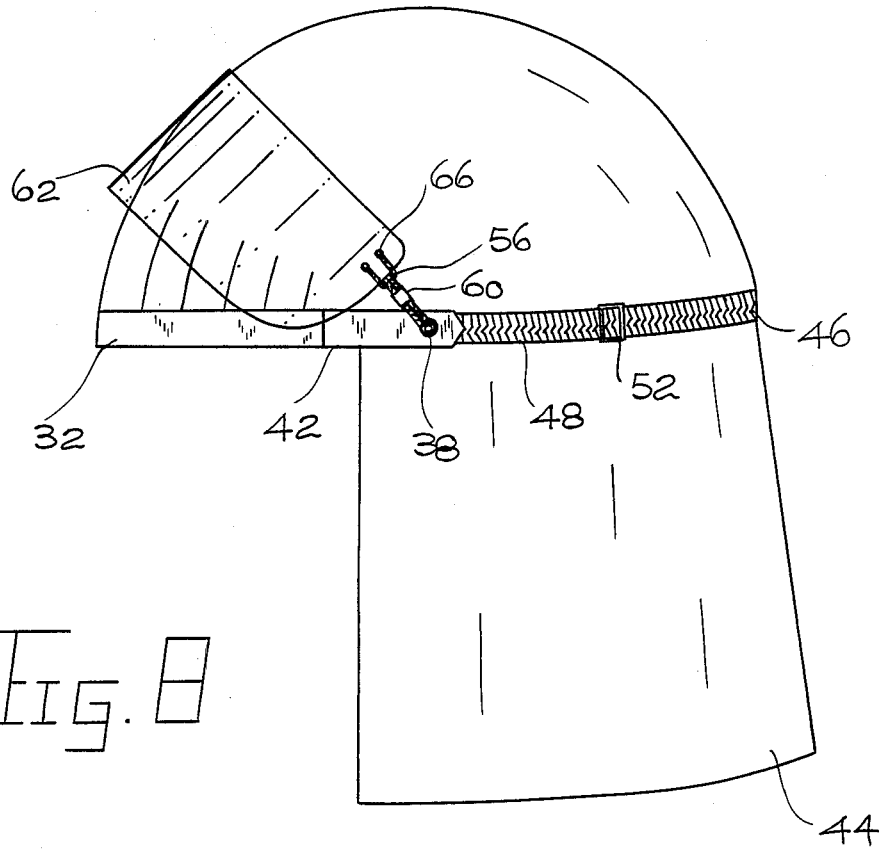
Figure 11:
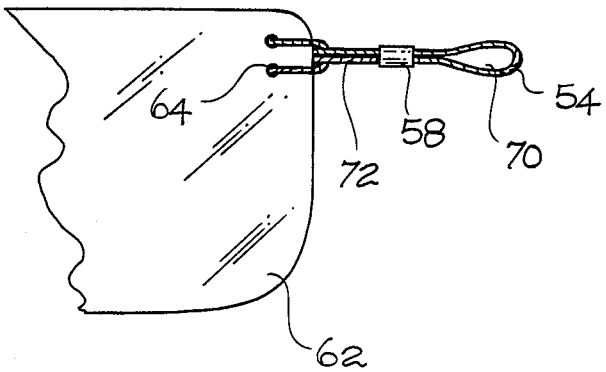
FIG. 11 is a top plan view of an enlarged fragmentary section of sun-visor with dual loops straps in a neutral state.
Figure 9:
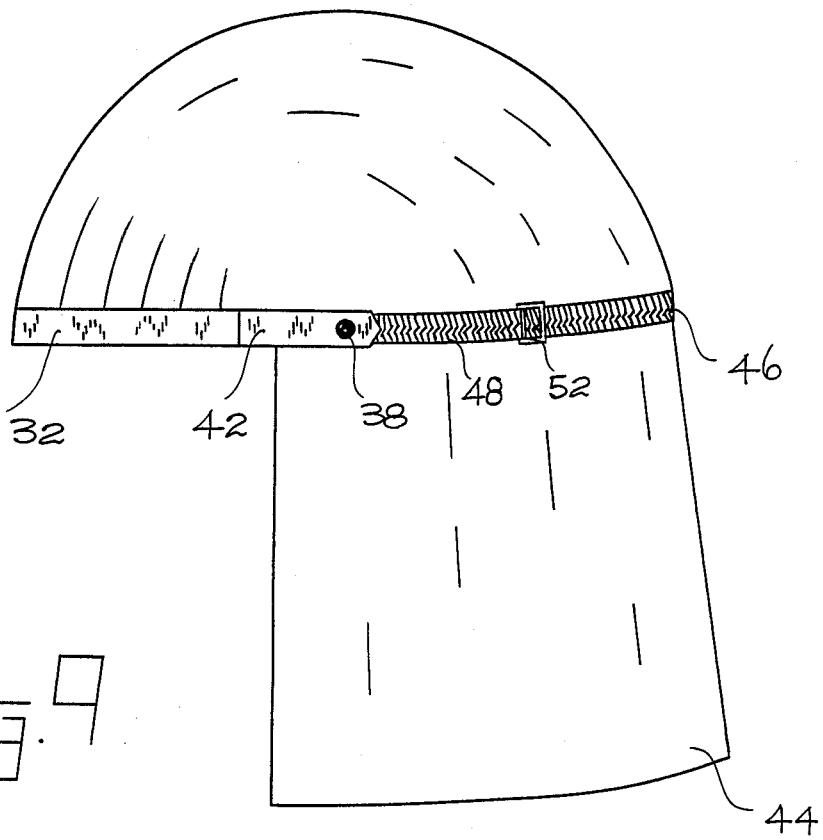
FIG. 9 is a side elevational view of headpiece with sun-visor removed.

Referring now to FIG. 6, the head cover 44, cut from any suitable fabric, sufficiently lightweight so as to feel comfortable on the head of wearer and sufficiently heavy-weight so as to protect the hair and neck of wearer from the sun, dust and the like; said fabric material shaped in a singular piece so as to run across the forehead, falling at an angle of approximately 90°, in the vicinity of the ear to the shoulder and covering the backneck, said headcover is secured to head of wearer by sewing to 32, the frontal portion of headband, cut from said fabric. Side portions 40 and 42 of headband, also cut from said fabric, are sewn to frontal portion 32, so as to extend length of headband. A highly absorbent sweatband 34, is placed within the sewn seams of frontal portion 32, the open side of frontal portion 32 is sewn to headcover 44, along the first stitched seam, so that sweatband 34 becomes enclosed within the seams of frontal portion 32. Said sweatband enclosure is further secured by top sewing the inner seams previously made by sewing headband side portion 40 and 42 to frontal portion 32. Two shank type buttons 36 and 38, are attached to headband side portions 40 and 42 so as to be positioned in the vicinity of the ear, one button on each side. The open ends of headband side portions 40 and 42, are sewm to headband elastic back portions 46 and 48, respectively. The unsewn end of elastic band 48, is looped around the left side shoulder of buckle 52, and sewn to itself, so as to keep buckle 52, stationary. The unsewn end of elastic band 46, is looped under the right shoulder, over the center shoulder and under the left shoulder of buckle 50—extended-looped under right shoulder and around center shoulder of buckle 52—extended-looped around buckle 50, from the underside and sewn to itself. Said elastic bands with buckles configuration, allows elastic band 46, to be lengthened or shortened by shifting buckle 50, along said elastic band 46, Thus providing the overall headband and headpiece adjustability to variable head sizes.

Figure 12:
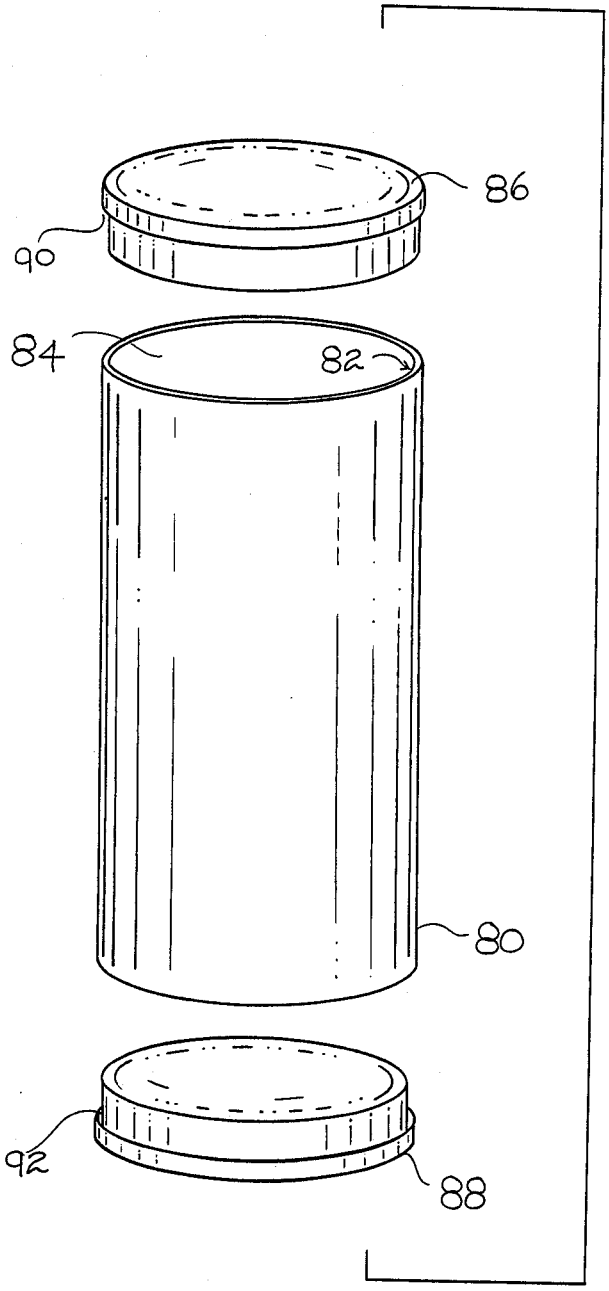
FIG. 12 is an exploded view of package.
Figure 13:
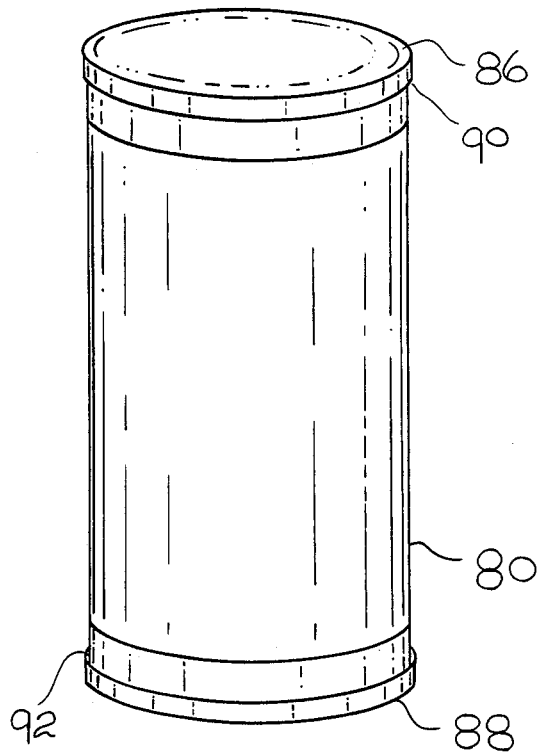
FIG. 13 is a perspective view the package.

Sun-visor 62, cut from a flat sheet of clear or tinted, yielding polymer material, with properties of reflecting or absorbing ultra-violet rays of the sun, is fitted with two pairs of holes 64 and 66, at the top left and right corners respectively. Said holes are made sufficiently close to the edges of sun-visor 62, so as to avoid breakage to said sun-visor, and sufficiently wide to accommodate the cord type elastic required by straps 54 and 56. The dual loops elastic strap 54, is formed by threading both ends with a cord-like elastic strip through pair of holes 64 of sun-visor. The ends of said elastic strip, now on the bottom side of said sun-visor, is brought forward from the right side and looped through the "U" thus formed on the top side of said sun-visor. The ends of said elastic strap are secured by metal attachment 58, thus forming dual loops 70 and 72, whereby loop 70, is sufficiently small to accommodate shank type button 36. Said dual loops elastic strap 54, is pulled to right, forming a knot which secures said strap through holes 64, and corner of sun-visor 62. Said procedure in forming dual loops strap 54, is repeated to form dual loops strap 56; holes 66, metal attachment 60, button 38, and top left corner of sun-visor 62. Said dual loops elastic straps 54 and 56, are adapted to provide sun-visor 62, with ease of motion up or down the face of wearer, so as to keep said sun-visor stationary once a position is determined by the wearer. The benefit of cutting sun-visor 62, from a flat sheet of yielding polymer material, is that said sun-visor remains flat and yielding, free from any design imposed curvature to it's vertical state when laid flat, as when not in use, thus allowing it to be concealed within the pages of a magazine if necessary or be rolled cylindrically and placed into a cylindrical tube package, FIGS. 12 and 13. Additionally, the provision of a sun-visor of material which absorbs or reflects the sun's ultra-violet rays, is significant, because sun related skin damage is often caused by over exposure to ultra-violet rays. Referring to FIG. 12, cylindrical tube 80, being formed from a transparent polymer material, having inner diameter 82, sufficiently large to accommodate the headpiece and sun-visor combination, when said sun-visor is rolled cylindrically and placed within cavity 84, said tube being additionally large in inner diameter to accommodate said headpiece, when it is rolled cylindrically and placed within the cavity of said rolled sun-visor, said tube being sufficiently long to accommodate said rolled sun-visor and headpiece, the ends of said tube are secured by top cover 86, and bottom cover 88, said covers provided with shoulders 90 and 92 so as to fit closely the inner circumference 82, of said tube, and become fixed thereto.

It should be clear that other embodiments such as a sun-visor and headpiece combination, provided with a sun-visor to which the elastic straps are attached through use of snap fasteners, or a head cover without the elastic headband portion, which instead is secured to wearer's head by tying elongated ends of a fabric headband behind the head of wearer, are contemplated as being within the scope of this invention, which is not to be construed to as limited to the particular forms as shown herein, which are to be considered illustrative rather than restrictive.

I claim:

1. A size adjustable sun-visor and headpiece combination adapted to be worn on the head of a wearer, comprising:

a headpiece having a single piece construction to cover the head of the wearer, said headpiece including a front portion to run across the forehead of the wearer and a rear portion extending downwardly at an angle of approximately 90° relative to said front portion to cover the backneck of the wearer;

a headband including a frontal portion, a rightside portion and a leftside portion connected together to provide an elongated headband;

said frontal portion of said headband being secured to said front portion of said headpiece with a highly absorbent sweatband sandwiched therebetween;

said rightside and leftside portions of said headband being secured respectively to opposite sides of said rear portion of said headpiece;

button means provided on each of said rightside and leftside portions of said headband to secure a sun-visor to said headband;

a first elastic back portion connected to said rightside portion of said headband, and a second elastic back portion connected to said leftside portion of said headband;

adjustable buckle means connecting said first and second elastic back portions together across said rear portion of said headpiece to adjust said headpiece to the head size of the wearer;

said adjustable buckle means including a first buckle attached permanently to said second elastic back portion, and a second buckle attached to said first elastic back portion in a horizontally movable connection therewith to permit adjustability of the length of said first elastic back portion; and said sun-visor including loop means for attaching and detaching said sun-visor from said headpiece, said loop means including two elastic straps secured on opposite sides of said sun-visor;

each of said two elastic straps having its ends secured so as to provide dual loops, each of said dual loops including an end loop, each said end loop being sufficiently small to accommodate said button means on said rightside and leftside portions of said headband to connect said sun-visor to said headband.

2. A size adjustable sun-visor and headpiece combination according to claim 1, wherein said sun-visor is fabricated from a yielding polymer material.

3. A size adjustable sun-visor and headpiece combination according to claim 2, wherein said polymer material is clear.

4. A size adjustable sun-visor and headpiece combination according to claim 2, wherein said polymer material is tinted.

5. A size adjustable sun-visor and headpiece combination according to claim 2, wherein said polymer material includes properties for absorbing ultra-violet rays from the sun.

6. A size adjustable sun-visor and headpiece combination according to claim 2, wherein said polymer material includes properties for reflecting ultra-violet rays from the sun.

7. A size adjustable sun-visor and headpiece combination according to claim 1, wherein said sun-visor has two pairs of holes provided in upper rightside and upper leftside corners thereof to each receive an associated one of said two elastic straps for securement of said two elastic straps to said sun-visor.

8. A size adjustable sun-visor and headpiece combination according to claim 1, wherein said headpiece is fabricated from any suitable fabric, said fabric being sufficiently lightweight so as to feel comfortable on the head of the wearer, and being sufficiently heavyweight so as to protect hair and neck of the wearer from the sun, sand and the like.

9. A size adjustable sun-visor and headpiece combination according to claim 1, wherein said button means includes two shank type buttons, one of said buttons for the rightside portion of said headband and the other one of said buttons for the leftside portion of said headband.

10. A size adjustable sun-visor and headpiece combination accoring to claim 1, wherein said sun-visor lacks any imposed curvature to its upper and under surfaces to permit said sun-visor to be rolled cylindrically when not in use.

11. A size adjustable sun-visor and headpiece combination according to claim 1, wherein said sun-visor and headpiece combination is constructed to be rolled cylindrically when not in use, and including a package for packaging said sun-visor and headpiece combination when said sun-visor and headpiece combination is rolled cylindrically.

12. A size adjustable sun-visor and headpiece combination according to claim 11, wherein said package includes a cylindrical tube having an inner diameter to accommodate said headpiece when rolled cylindrically and placed within the cavity of said sun-visor when said sun-visor is also rolled cylindrically and placed within said tube, opposite ends of said tube being secured with a top cover and a bottom cover.

13. A size adjustable sun-visor and headpiece combination according to claim 12, wherein said top and bottom covers are each provided with shoulders to closely fit an inner circumference of said tube and become fixed thereto.

14. A size adjustable sun-visor and headpiece combination according to claim 12, wherein said tube is fabricated from a polymer material.

15. A size adjustable sun-visor and headpiece combination according to claim 13, wherein said polymer material of said tube is transparent.

* * * * *